US006559746B2

(12) United States Patent
Takanashi et al.

(10) Patent No.: US 6,559,746 B2
(45) Date of Patent: May 6, 2003

(54) THRUST CONTROLLABLE ACTUATOR

(75) Inventors: Seiji Takanashi, Tsukuba-gun (JP); Shigeru Komoriya, Tsukuba-gun (JP); Kazuya Tamura, Tsukuba-gun (JP); Hisashi Yajima, Tsukuba-gun (JP); Takashi Nagao, Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 72 days.

(21) Appl. No.: 09/839,115

(22) Filed: Apr. 23, 2001

(65) Prior Publication Data

US 2001/0043133 A1 Nov. 22, 2001

(30) Foreign Application Priority Data

May 22, 2000 (JP) ..... 2000-150327

(51) Int. Cl.[7] ..... H01F 3/00; H01F 7/08
(52) U.S. Cl. ..... 335/256; 335/255; 335/253
(58) Field of Search ..... 335/256

(56) References Cited

U.S. PATENT DOCUMENTS 4,448,460 A * 5/1984 Yamamoto ..... 308/5 R
4,553,056 A * 11/1985 Pfister ..... 310/80
4,992,766 A * 2/1991 Suzuki et al. ..... 335/223
5,488,278 A * 1/1996 McGraw et al. ..... 318/135
5,947,155 A * 9/1999 Miki et al. ..... 137/625.65

* cited by examiner

*Primary Examiner*—Elvin Enad
*Assistant Examiner*—Bernard Rosas
(74) *Attorney, Agent, or Firm*—Oblon, Spivak, McClelland, Maier & Neustadt, P.C.

(57) ABSTRACT

A thrust producer of a moving-magnet type includes a rod supported for upward and downward movements by an apparatus main body through an air hydrostatic bearing and a thrust producer for moving the rod up and down, the thrust producer has a magnet mounted to the rod to be displaced with the rod and a coil provided to the apparatus main body to generate magnetic force when the coil is energized, and the thrust producer produces thrust by an interaction of the magnet and the magnetic force generated by the coil.

8 Claims, 3 Drawing Sheets

THRUST CONTROLLABLE ACTUATOR

TECHNICAL FIELD

The present invention relates to an actuator in which thrust of a rod for moving up and down can be controlled.

PRIOR ART

Upward and downward movements of a rod are normally guided by a guide of a contact type such as a linear guide. When such a rod of contact support is moved up and down by means which can finely control thrust by controlling energization as is the case with a thrust producer of a moving-magnet type, driving control of 5% or less of full thrust is difficult.

DISCLOSURE OF THE INVENTION

The present invention has been accomplished to solve the above problem and it is a technical object of the invention to provide an actuator in which thrust control can be easily carried out even with driving control of 5% or less of full thrust.

To achieve the above object, according to the invention, there is provided an actuator comprising a rod supported for upward and downward movements by an apparatus main body and a thrust producer for producing thrust for moving the rod up and down, wherein the rod is supported in a noncontact state by a bearing portion of the apparatus main body through an air hydrostatic bearing, the thrust producer is of a moving-magnet type including a magnet mounted to the rod to be displaced with the rod and a coil provided to the apparatus main body to generate magnetic force when the coil is energized, and the thrust producer produces the thrust by an interaction of the magnet and the magnetic force generated by the coil.

In the actuator having the above structure, the thrust of the rod can be finely controlled by the thrust producer of the moving-magnet type. Furthermore, because the rod is supported in the noncontact state by the bearing portion of the apparatus main body through the air hydrostatic bearing, driving of 5% or less of full thrust can be easily controlled in driving up and down the rod.

According to a concrete embodiment of the invention, the thrust producer includes two magnets and two coils which can generate different amounts of thrust and energization of which can be controlled individually, one of the coils controls a large load which is mainly weight of the rod, and the other of the coils controls a small load which is mainly upward and downward movements of the rod.

According to another concrete embodiment of the invention, the rod is supported in upper and lower two positions by two air hydrostatic bearings, the thrust producer is disposed between the air hydrostatic bearings, the magnet in the thrust producer is fitted with an outer periphery of the rod, and the coil is disposed to surround an outer periphery of the magnet.

In the invention, it is preferable that the apparatus main body includes a cylindrical casing portion having therein a rod hole, the rod is provided to pass through the rod hole in the casing portion, the bearing portion is provided to each of upper and lower ends of the casing portion, and the thrust producer is provided to the casing portion between the bearing portions.

According to another concrete embodiment of the invention, the rod is rotatable, the apparatus main body includes a motor for rotating the rod, a rotating shaft of the motor and the rod are connected to each other through a joint for transmitting rotation between the rotating shaft and the rod and for allowing axial movements of the rotating shaft and the rod with respect to each other.

In the invention, it is possible that a load cell pressurized by displacement of the rod is provided between the apparatus main body and the rod and that output of the load cell is fed back to a driving system of the thrust producer. In this case, the load cell is mounted onto a support provided to the apparatus main body such that a pressurizing portion is close to the rod, a contact is mounted to the pressurizing portion, and a flange-shaped contact member for coming in contact with the contact is fixed to the rod.

DETAILED DESCRIPTION

Figure 1:
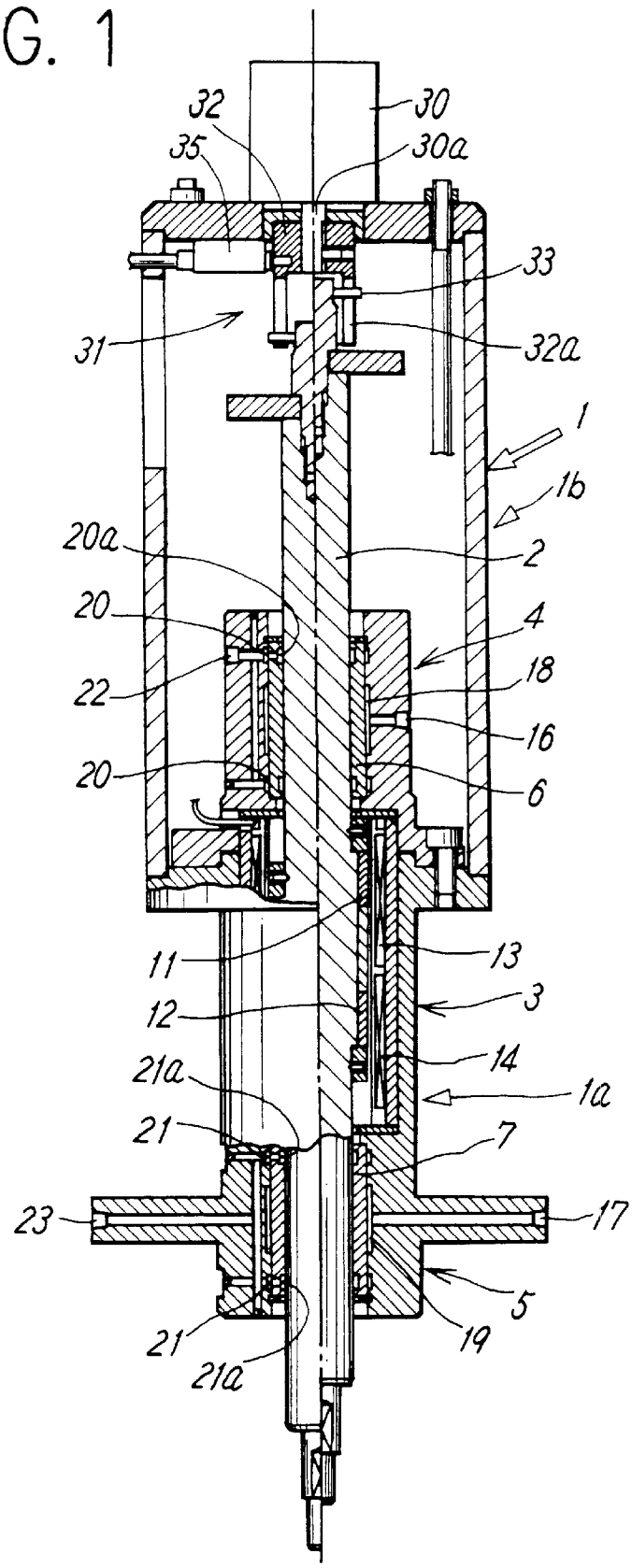
FIG. 1 is a partial sectional view showing a structure of a first embodiment of an actuator according to the present invention.

FIG. 1 shows a first embodiment of a thrust controllable actuator according to the present invention. The actuator of the first embodiment has a cylindrical apparatus main body 1. The apparatus main body 1 has a first casing portion 1*a* in a small-diameter cylindrical shape having therein a rod hole and a second casing portion 1*b* in a large-diameter cylindrical shape connected to an upper portion of the first casing portion 1*a* such that a part of an upper end of the first casing portion 1*a* is enveloped in the second casing portion 1*b*.

A rod 2 is provided in the rod hole of the first casing portion 1*a* so as to vertically pass through the first casing portion 1*a*. Two bearing portions 4 and 5 are provided to upper and lower ends of the first casing portion 1*a* and air hydrostatic bearings 6 and 7 are respectively mounted in the bearing portions 4 and 5. By the air hydrostatic bearings 6 and 7, the rod 2 is supported in two positions thereof and for moving up and down and rotation. A thrust producer 3 for producing thrust for supporting and moving up and down of the rod 2 is provided to the first casing portion 1*a* between the bearing portions 4 and 5.

The thrust producer 3 is formed of two magnets 11 and 12 fitted over an outer peripheral face of the rod 2 at a necessary distance from each other and two coils 13 and 14 with different numbers of turns and disposed to surround the magnets 11 and 12 in the first casing portion 1*a* and is of a moving-magnet type in which the magnets 11 and 12 move with the rod 2. The number of turns of the one coil 13 is set to be large to adapt to a large load which is mainly weight of the rod 2 and the like and the number of turns of the other coil 14 is set to be sufficiently smaller than that of the coil 13 to adapt to a small load which is mainly moving up and down of the rod 2. The respective coils 13 and 14 are connected to a controller for independently controlling energization of the coils 13 and 14.

Produced thrust is changed by changing the numbers of turns of the coils 13 and 14. However, the coils 13 and 14 are not limited to such structures and it is also possible that necessary thrust is produced by changing wire diameters of the coils or the like, for example.

Therefore, by interactions between magnetic forces generated by energizing the coils 13 and 14 and magnetic forces of the magnets 11 and 12, thrust is applied to the rod 2. The coil 13 balances mainly weight of rod 2 and the like to some degree and the coil 14 controls mainly moving up and down of the rod 2 to thereby finely control thrust in a wide range.

Proportions of thrust produced by the coils 13 and 14 can be set arbitrarily according to conditions of actual use.

The rod 2 is supported for sliding by the air hydrostatic bearings 6 and 7 at the bearing portions 4 and 5 provided to opposite sides of the thrust producer 3 as described above. The air hydrostatic bearings 6 and 7 are made of porous breathing raw material and substantially uniformly spout compressed air supplied through passages 18 and 19 from bearing air supply ports 16 and 17 provided to the bearing portions 4 and 5 to the outer peripheral face of the rod 2 through insides of the breathing raw material to thereby support the rod 2 such that the rod 2 is hardly in contact with bearing surfaces.

Air discharged outside from the air hydrostatic bearings 6 and 7 is discharged outside through peripheral grooves 20 and 21 provided to be positioned on vertical opposite sides of the passages 18 and 19 in the respective bearing portions 4 and 5 and through bearing air discharge ports 22 and 23 communicating with the peripheral grooves 20 and 21. Air collecting grooves 20*a* and 21*a* are provided to bearing inner peripheral faces of the air hydrostatic bearings 6 and 7 in positions corresponding to the peripheral grooves 20 and 21.

In order to apply rotation at a necessary angle besides upward and downward movements to the rod 2, as shown in FIG. 1, a motor 30 such as a stepping motor a rotation angle of which is controllable is provided in a central position of an upper end of the second casing portion 1*b* of the apparatus main body 1 and a rotating shaft 30*a* of the motor 30 and the rod 2 are connected by a joint 31 for transmitting rotation of the rotating shaft 30*a* to the rod 2 and for allowing axial movements of the rotating shaft 30*a* and the rod 2 with respect to each other. The joint 31 is formed by cutting a groove 32*a* in an axial direction in a cylindrical shaft 32 fixed to the rotating shaft 30*a* and fitting a transmission pin 33 projecting in such a direction to be orthogonal to the axial direction at an upper end of the rod 2 into this groove 32*a*. However, a structure of the joint 31 is not limited to one shown in the drawings and joints with other structures having the similar function can be also used.

A sensor 35 for detecting a rotation angle of the cylindrical shaft 32 is provided to be close to an outer periphery of the cylindrical shaft 32 at a peripheral portion of the cylindrical shaft 32 at an upper portion of the second casing portion 1*b*. The rotation angle detected by the sensor 35 is fed back to a driving system of the motor 30.

In the actuator having the above structure, by controlling energization of the thrust producer 3 of the moving-magnet type, thrust in the direction of the upward and downward movements of the rod 2 can be finely controlled. Furthermore, because the rod 2 is supported in a noncontact state by supplying compressed air from the bearing air supply ports 16 and 17 to the air hydrostatic bearings 6 and 7, the rod 2 is supported in a floating state in which the rod 2 is hardly in contact with the bearing surfaces. Therefore, in upward and downward driving of the rod 2 by the thrust producer 3, driving control by thrust of 5% or less of full thrust, which is a limit of driving control of the rod of contact support can be carried out easily.

Figure 2:
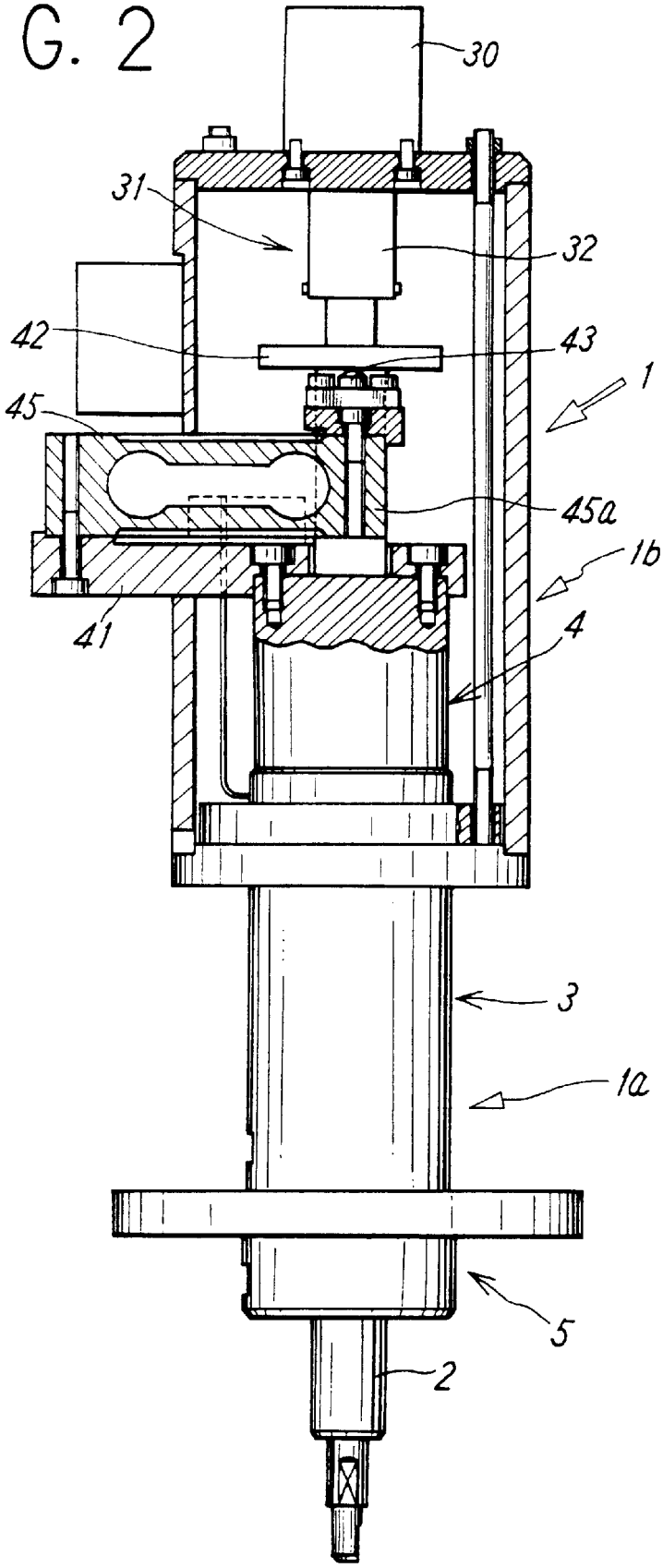
FIG. 2 is a partial sectional view showing a structure of a second embodiment of the actuator according to the invention.
Figure 3:
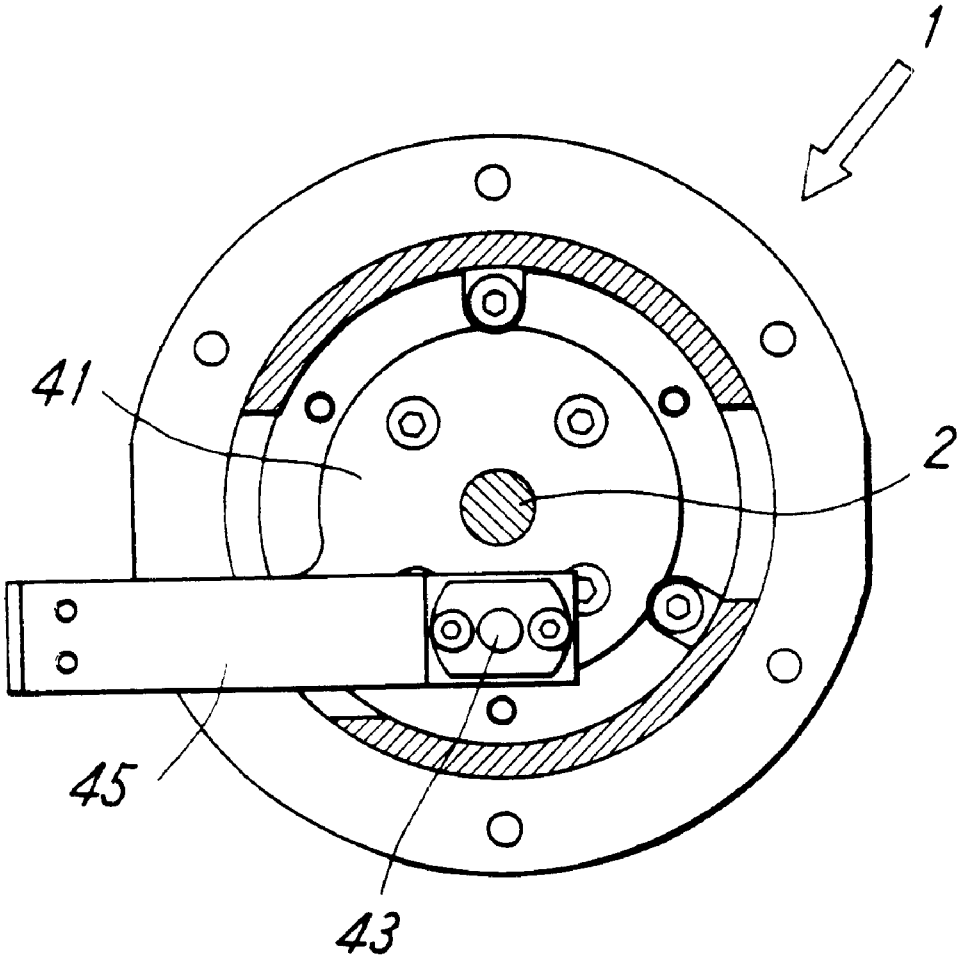
FIG. 3 is a plan view showing a load cell portion in the second embodiment.

FIGS. 2 and 3 show a second embodiment in which a load cell is attached to the actuator of the first embodiment according to the invention.

In the actuator of the second embodiment, similarly to the case of the first embodiment in FIG. 1, the rod 2 moving up and down by driving of the thrust producer 3 is supported for vertical sliding by the air hydrostatic bearings in the bearing portions 4 and 5 on upper and lower sides of the thrust producer 3 in the apparatus main body 1. Because these structures and operations are similar to those in the above-described first embodiment, description of them will be omitted.

In this actuator, a support 41 projecting sideways is provided in a position on the bearing portion 4 close to one side in the apparatus main body 1. The load cell 45 is mounted onto the support 41 such that a pressurizing portion 45*a* is close to the rod 2. A contact 43 having a spherical head is mounted to the pressurizing portion 45*a*. On the other hand, a disc-shaped contact member 42 for coming in contact with the contact 43 in a position close to a periphery is fixed to the rod 2. A control system for detecting the thrust of the rod 2 moved up and down by the thrust producer 3 by the load cell 45 and for feeding the detected thrust back to the driving system of the thrust producer 3 is provided.

In the second embodiment, even if the rod 2 is rotated by the motor 30, the contact 43 merely moves at a peripheral portion of the disc-shaped contact member 42 and there is no hindrance to detection of the thrust.

In the actuator of the second embodiment, when the thrust producer 3 is driven downward, the contact member 42 presses the contact 43 and the thrust is detected by the load cell 45. Therefore, by feeding the detected thrust back to the driving system of the thrust producer 3, the thrust of the rod 2 can be controlled accurately.

In an experiment, in a state in which thrust of 350 g was applied in a direction reverse to gravity to the rod having a mass of 450 g, an amount of electric current was controlled at an interval of 1 mA and load control could be carried out at an interval of 1 g in a range of 0 to 10 g, 3 g in 10 to 50 g, and 5 g in 50 to 100 g. This is 5% or less of a case in which a load of 100 g is controlled. An influence of friction in the joint 31 is large and therefore, the thrust can be controlled more accurately by canceling the friction.

According to the actuator of the invention described above in detail, the thrust of the rod in the direction of upward and downward movements can be finely controlled by controlling energization of the thrust producer of the moving-magnet type. Because the rod is supported in the noncontact state by supplying compressed air to the air hydrostatic bearing, the rod is supported in the floating state in which the rod is hardly in contact with the bearing surfaces. Therefore, in upward and downward driving of the rod by the thrust producer, even in driving control by thrust of 5% or less of full thrust, which is a limit of driving control of the rod of contact support, the thrust can be controlled easily. It is also possible to apply arbitrary rotation to the rod.

In the above actuator, it is possible to further finely control the thrust in a wide range by providing two coils with different numbers of turns to the thrust producer, adapting the one coil to the large load which is mainly weight of the rod, adapting the other coil to the small load which is mainly moving up and down of the rod, and making control of energization of the respective coils possible.

What is claimed is:

1. A thrust controllable actuator comprising a rod supported for upward and downward movements by an apparatus main body and a thrust producer for producing thrust for moving said rod up and down, wherein said rod is supported in a noncontact state by a bearing portion of said apparatus main body through an air hydrostatic bearing, said thrust producer is of a moving-magnet type including at least one magnet mounted to said rod to be displaced with said rod and a coil provided to said apparatus main body to generate magnetic force when said coil is energized, and said thrust producer produces said thrust by an interaction of said magnet and said magnetic force generated by said coil, wherein said thrust producer includes first and second magnets and first and second coils which can generate different amounts of thrust and energization of which can be controlled individually, the first of said coils controls a large load which is mainly a weight of said rod, and the second of said coils controls a small load which is mainly upward and downward movements of said rod.

2. An actuator according to claim 1, wherein said rod is rotatable, said apparatus main body includes a motor for rotating said rod, a rotating shaft of said motor and said rod are connected to each other through a joint for transmitting rotation between said rotating shaft and said rod and for allowing axial movements of said rotating shaft and said rod with respect to each other.

3. An actuator according to claim 1, wherein a load cell pressurized by displacement of said rod is provided between said apparatus main body and said rod and an output of said load cell is fed back to a driving system of said thrust producer.

4. An actuator according to claim 1, wherein said load cell is mounted onto a support provided to said apparatus main body such that a pressurizing portion is close to said rod, a contact is mounted to said pressurizing portion, and a flange-shaped contact member for coming in contact with said contact is fixed to said rod.

5. A thrust controllable actuator comprising a rod supported for upward and downward movements by an apparatus main body and a thrust producer for producing thrust for moving said rod up and down, wherein said rod is supported in a noncontact state by a bearing portion of said apparatus main body through an air hydrostatic bearing, said thrust producer is of a moving-magnet type including at least one magnet mounted to said rod to be displaced with said rod and a coil provided to said apparatus main body to generate magnetic force when said coil is energized, and said thrust producer produces said thrust by an interaction of said magnet and said magnetic force generated by said coil, wherein said apparatus main body includes a cylindrical casing portion having therein a rod hole, said rod is provided to pass through said rod hole in said casing portion, said bearing portion is provided to each of upper and lower ends of said casing portion, said thrust producer is provided to said casing portion between said bearing portions, said magnet in said thrust producer is fitted with an outer periphery of said rod, and said coil is disposed in said casing portion to surround an outer periphery of said magnet, and wherein said thrust producer includes first and second magnets and first and second coils which can generate different amounts of thrust and energization of which can be controlled individually, said first and second magnets are mounted to said outer periphery of said rod at a distance from each other, and each of said first and second coils is disposed in said casing portion to surround each said magnet.

6. An actuator according to claim 5, wherein said rod is rotatable, said apparatus main body includes a motor for rotating said rod, a rotating shaft of said motor and said rod are connected to each other through a joint for transmitting rotation between said rotating shaft and said rod and for allowing axial movements of said rotating shaft and said rod with respect to each other.

7. An actuator according to claim 5, wherein a load cell pressurized by displacement of said rod is provided between said apparatus main body and said rod and output of said load cell is fed back to a driving system of said thrust producer.

8. An actuator according to claim 5, wherein said load cell is mounted onto a support provided to said apparatus main body such that a pressurizing portion is close to said rod, a contact is mounted to said pressurizing portion, and a flange-shaped contact member for coming in contact with said contact is fixed to said rod.

* * * * *